US006199398B1

(12) United States Patent
Takeuchi et al.

(10) Patent No.: US 6,199,398 B1
(45) Date of Patent: Mar. 13, 2001

(54) VEHICLE COOLING SYSTEM WITH SYSTEM MOTOR CONTROL APPARATUS

(75) Inventors: Kazuhiro Takeuchi, Okazaki; Toshiki Sugiyama, Kariya; Takuya Usami, Kariya; Satoshi Yoshimura, Kariya; Junji Sugiura, Toyota, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/208,512

(22) Filed: Dec. 9, 1998

(30) Foreign Application Priority Data

Dec. 10, 1997 (JP) ..... 9-340311
Dec. 2, 1998 (JP) ..... 10-343153

(51) Int. Cl.[7] ..... F25B 27/00
(52) U.S. Cl. ..... 62/323.1; 62/133
(58) Field of Search ..... 62/323.1, 133, 62/186; 236/35; 123/41.12

(56) References Cited

U.S. PATENT DOCUMENTS 4,425,766 * 1/1984 Claypole ..... 62/133
4,441,462 * 4/1984 Budinski ..... 123/41.11
4,590,772 * 5/1986 Nose et al. ..... 62/184
5,947,189 * 9/1999 Takeuchi et al. ..... 165/51
5,957,663 * 9/1999 Van Houten et al. ..... 417/13

FOREIGN PATENT DOCUMENTS 4-365923 12/1992 (JP) .
8-260965 10/1996 (JP) .

* cited by examiner

*Primary Examiner*—William Doerrler
*Assistant Examiner*—Melvin Jones
(74) *Attorney, Agent, or Firm*—Harness, Dickey & Pierce, PLC

(57) ABSTRACT

A vehicle cooling apparatus having a simple construction that enables the size of a cooling fan electric motor to be reduced without the need to increase the number of batteries provided for driving the motor. The cooling fan provides necessary cooling for an engine radiator and an air-conditioning system condenser by driving the motor at an input power lower than its rated power by a predetermined amount until the temperature of the engine cooling water reaches a predetermined temperature. If the water temperature rises above the predetermined temperature, the electric motor input power is increased to a level greater than its rated input power for a predetermined time period. As a result, cooling capacity can be increased and the water temperature can be lowered with a smaller motor when the water temperature has become abnormally high. Because the electric motor is normally driven at an input power lower than its rated input power, the life of the electric motor is increased.

15 Claims, 6 Drawing Sheets

VEHICLE COOLING SYSTEM WITH SYSTEM MOTOR CONTROL APPARATUS

CROSS-REFERENCE TO RELATED APPLICATIONS

This application is related to, and claims priority from, Japanese Patent Applications Hei. 9-340311 and Hei. 10-343153, the contents of which are incorporated herein by reference.

BACKGROUND OF THE INVENTION

1. Technical Field

This invention relates generally to a vehicle cooling system, and particularly to a control apparatus for controlling cooling of a vehicle radiator and air-conditioning condenser.

2. Discussion

A vehicle cooling apparatus is disclosed in Japanese Patent Application Laid-Open No. Hei. 4-365923. In this related art apparatus, an electric cooling fan for drawing cooling air through a radiator is controlled by pulse width modulation (PWM) in correspondence with the temperature of cooling water passing through the radiator.

In such an apparatus, a main battery and a sub battery are mounted in the vehicle, and the sub battery is used when the cooling water temperature reaches a predetermined high temperature. More particularly, the main battery and the sub battery are connected in series, and, when the cooling water temperature reaches the predetermined high temperature, the input power of a cooling fan electric motor is increased above the motor's rated input power (motor rated input power is defined as the input power of a motor in a control circuit in which an air conditioner start-up fan control voltage, or a fan voltage reached when refrigerant pressure exceeds a predetermined value, approximately equals a vehicle battery voltage under a vehicle standard voltage).

However, because the above apparatus requires two batteries, space required for the apparatus and overall vehicle cost are both increased. Also, because a switching circuit for the main battery/sub battery series connection is required, the number of parts and overall system complexity are increased.

SUMMARY OF THE INVENTION

It is therefore an object of the present invention to provide a vehicle cooling apparatus which is of a simple construction, thereby enabling the size of the associated electric motor to be reduced and the need for an extra battery to be eliminated.

Accordingly, the present invention provides a controller that generates motor control signals in response to sensed system operating parameters, and a switching device that receives the motor control signals from the controller and that drives the motor in response thereto. The controller generates the motor control signals at a highest target duty ratio among target duty ratios calculated based on the sensed system operating parameters. This highest target duty ratio results in an input power provided to the motor by the switching device to be below a rated input power of the motor when the sensed system operating parameters are below a predetermined level. The highest target duty ratio remains above the rated input power only for a predetermined time period when a system operating parameter is above the predetermined level.

Thus with the present invention, while only a small electric motor is required, an input power greater than the rated input power of the electric motor can be applied via a change in the duty ratio. Consequently, an additional battery is not necessary, and the cooling apparatus structure is simplified.

Also, in the present invention, the time that the electric motor is used at or above its rated input power is kept short. Compared to a conventional system in which the electric motor is used at or above its rated input power for longer than the predetermined time, the durability of the electric motor is increased.

DETAILED DESCRIPTION OF THE PREFERRED EMBODIMENTS

Figure 1:
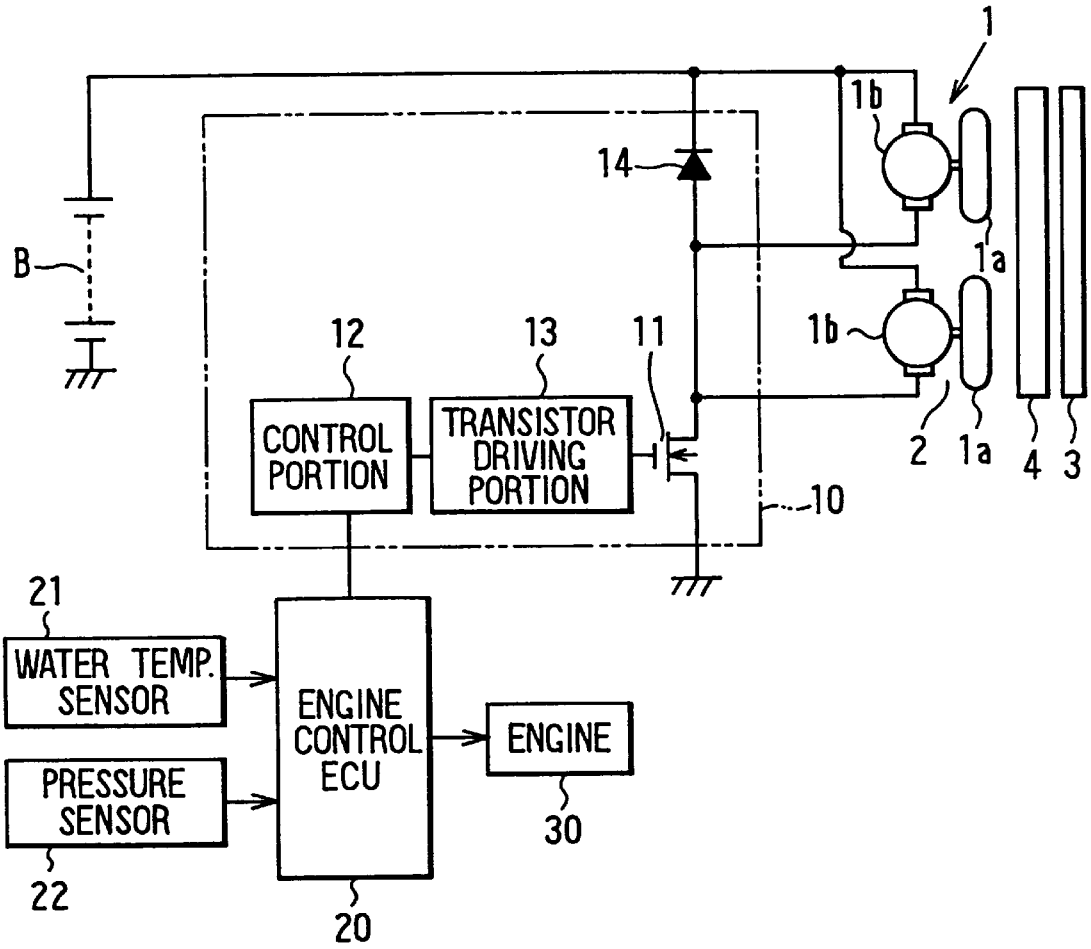
FIG. 1 is a schematic view showing the construction of a preferred embodiment of a vehicle cooling apparatus according to the invention.

The overall construction of a preferred embodiment of a vehicle cooling system and control apparatus according to the invention is shown in FIG. 1.

The system includes a radiator 4 for cooling water flowing through the inside of a vehicle internal combustion engine 30. The cooling system also has a condenser 3, which forms a constituent part of a refrigerating cycle of a vehicle air-conditioning system. The condenser 3 cools and condenses high-temperature, high-pressure refrigerant flowing through it. The radiator 4 and the condenser 3 are mounted in an engine compartment (not shown), one behind the other at lengthwise direction of the vehicle, and are positioned so that a draft created by vehicle motion passes through the radiator and condenser. Preferably, the condenser 3 is disposed in front of the radiator 4.

The cooling water and refrigerant inside the radiator 4 and the condenser 3 respectively are cooled by air flow generated by electric fans 1 mounted behind the radiator 4 and the condenser 3. The electric fans 1 are made up of two cooling fans 1*a* and two electric motors 1*b* (d.c. motors) for driving the two cooling fans 1*a*.

The electric motors 1*b* are driven by a battery voltage supplied from a vehicle battery B through an ignition switch (not shown), and are controlled by a motor control unit 10. The motor control unit 10 includes a MOS transistor 11 including a semiconductor switching device for driving the electric motors 1*b*, a control part 12 for outputting a pulse signal for controlling the electric motors 1*b* by pulse width modulation (PWM), a transistor driving part 13 for amplifying the pulse signal from the control part 12 and driving the MOS transistor 11, and a diode 14 for absorbing back electromotive force.

The control part 12 receives a water temperature control signal for keeping the cooling water temperature at a predetermined temperature from an engine control ECU 20, which controls the engine.

The engine control ECU 20 takes in sensor signals from various sensors necessary for performing engine control. These sensors include a water temperature sensor 21 for detecting the temperature of the engine cooling water and a pressure sensor 22 for detecting a high-side pressure of high-pressure refrigerant flowing through the condenser 3. The engine control ECU 20 outputs the above-mentioned water temperature control signal to the control part 12 based on the cooling water temperature detected by the water temperature sensor 21.

Operation of the present invention will now be explained through a description of control processing carried out by the control part 12 shown in FIG. 1. This operation is carried out after the ignition switch (not shown) is switched on and the engine 30 is started.

Figure 2:
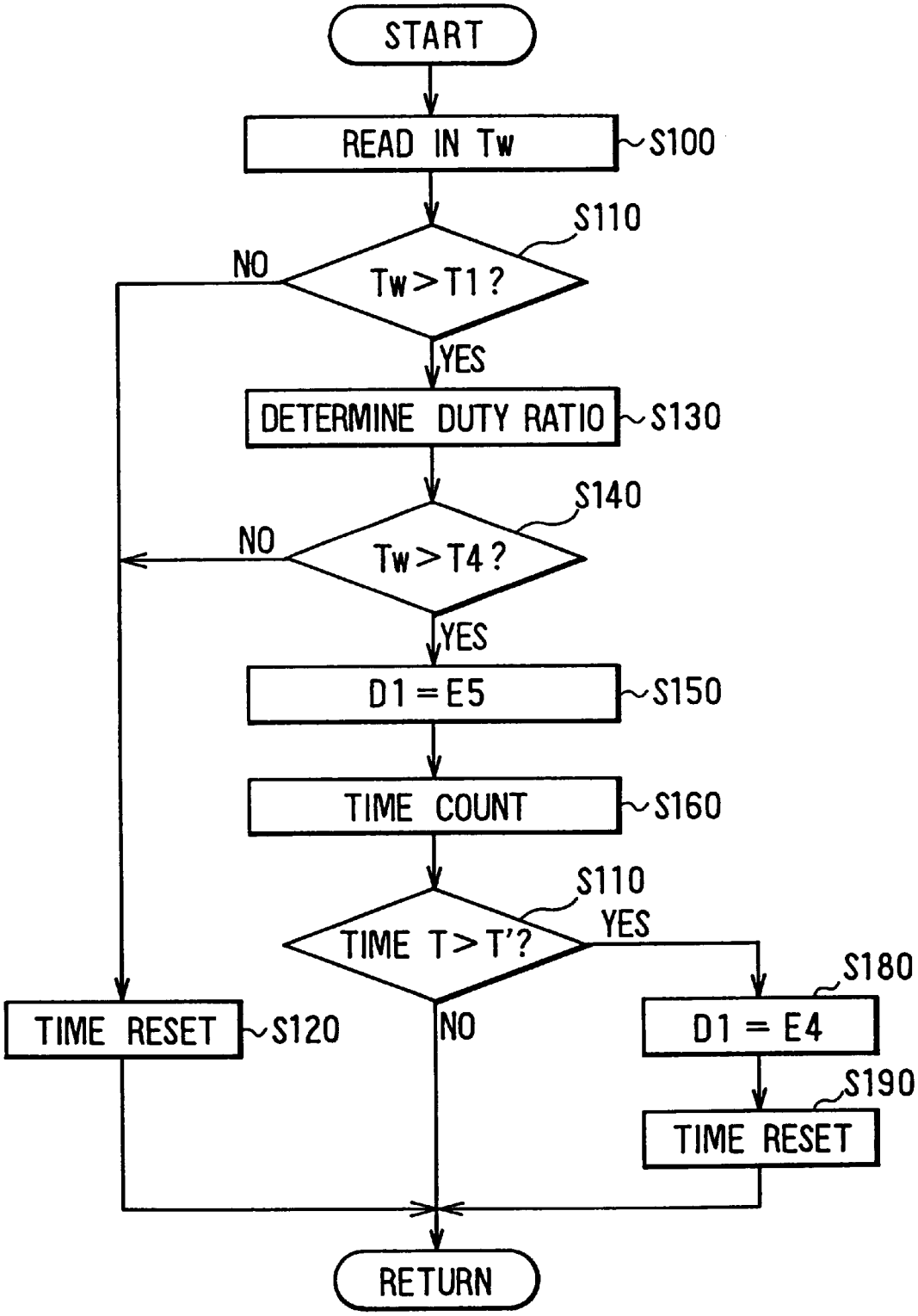
FIG. 2 is a flow diagram showing the operation of the preferred embodiment.

First, as shown in FIG. 2, at step S100, the detection signal Tw of the water temperature sensor 21 is input. Then, at step S110, it is determined whether or not the water temperature Tw is higher than a first predetermined temperature T1 (for example 90° C.). When it is determined at step S110 that the water temperature Tw is lower than the first predetermined temperature T1, processing proceeds to step S120, and a timer is reset before the processing returns, as it is not necessary for the cooling water to be cooled, and therefore it is not necessary for the electric motors 1*b* to be driven.

When on the other hand it is determined at step S110 that the water temperature Tw is higher than the first predetermined temperature T1, it is inferred that it is necessary for the electric motors 1*b* to be driven. Therefore, at step S130 an input power of the electric motors 1*b*, that is, a first target duty ratio D1 of pulse width modulation (PWM), is determined. This first target duty ratio D1 is determined from a map stored in ROM (not shown) inside the motor control unit 10. This map is shown in FIG. 3.

Figure 3:
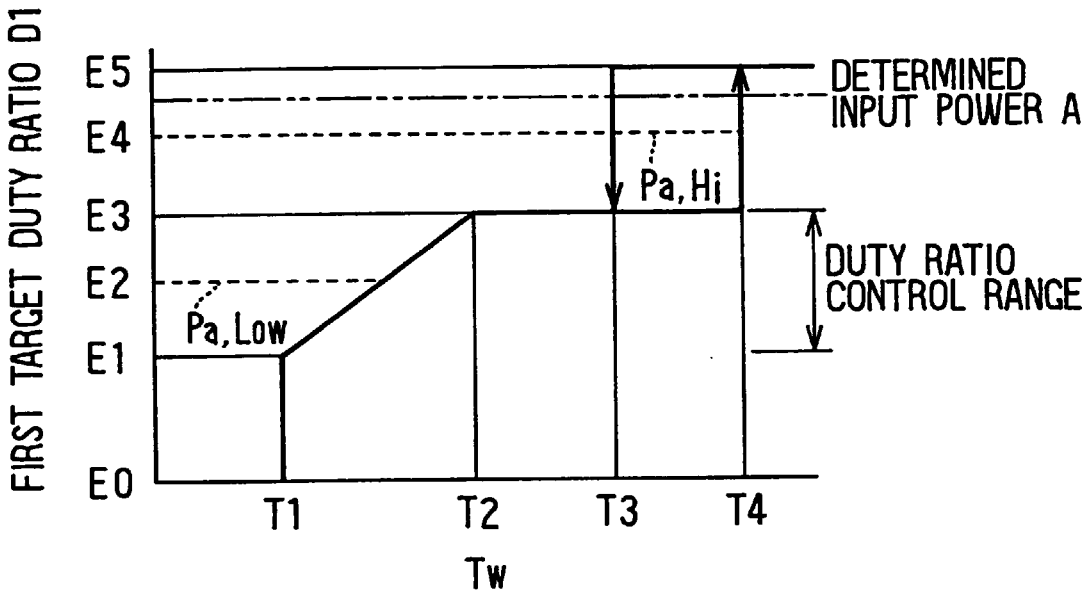
FIG. 3 is a graph showing a relationship between a water temperature and a first target duty ratio D1 in the preferred embodiment.

The map of FIG. 3 is set so that when the water temperature Tw is lower than the first predetermined temperature T1 the first target duty ratio D1 becomes zero, as in the foregoing description, and when the water temperature Tw is between the first predetermined temperature T1 and a second predetermined temperature T2 (for example 100° C.), the first target duty ratio D1 increases as the water temperature Tw increases. When, in the process of increasing, the water temperature Tw is between the second predetermined temperature T2 and a fourth predetermined temperature T4, the first target duty ratio D1 has a fixed value E3 (for example 70%).

Then, at step S140, it is determined whether or not the water temperature Tw is higher than the fourth predetermined temperature T4 (for example 105° C.). When at step S140 it is determined that the water temperature Tw is higher than the fourth predetermined temperature T4, processing proceeds to step S150, and the first target duty ratio D1 is set to a maximum value E5 (of 100%, at which the MOS transistor 11 is constantly on and the rated voltage of the battery B, for example 12 V, is constantly impressed) as shown in FIG. 3.

After the first target duty ratio D1 is set to the maximum value E5, at step S160, timer counting is started. Processing then proceeds to step S170, and it is determined whether or not the timer time T counted at step S160 has reached a predetermined time T' (for example sixty seconds). When at step S170 it is determined that the timer time T has reached the predetermined time T', processing proceeds to step S180 and the first target duty ratio D1 is set to the value E4 in FIG. 3, after which processing proceeds to step S190 and the timer count is reset.

Thus, a first target duty ratio D1 is determined based on the water temperature Tw.

On the other hand, when an air-conditioning start switch (a switch driving the compressor of the refrigerating cycle) of the vehicle air-conditioning system (not shown) is turned on, the following processing is carried out. That is, a cooling capacity required on the refrigerating cycle side, i.e. the condenser 3 side, is determined based on the detection signal Pa of the pressure sensor 22. This is determined from a map stored in ROM (not shown) shown in FIG. 4.

Figure 5:
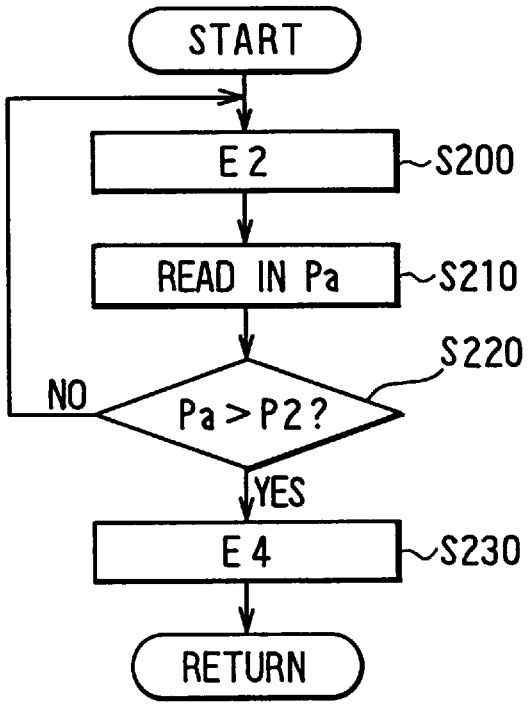
FIG. 5 is another flow diagram showing the operation of the preferred embodiment.

Referring to FIG. 5, at step S200, an input power for the electric motors 1*b*, that is, a second target duty ratio D2, is set to a value E2 (50%). Then, at step S210, the detection signal Pa of the pressure sensor 22 is read. Next, at step S220, it is determined whether or not this pressure Pa is higher than a first predetermined pressure P2. When the pressure Pa is higher than the first predetermined pressure P2, processing proceeds to step S230 and recalculates the power to be input to the electric motors 1*b*, i.e. the second target duty ratio D2. Specifically, D2 becomes a value E4 (80%).

Figure 4:
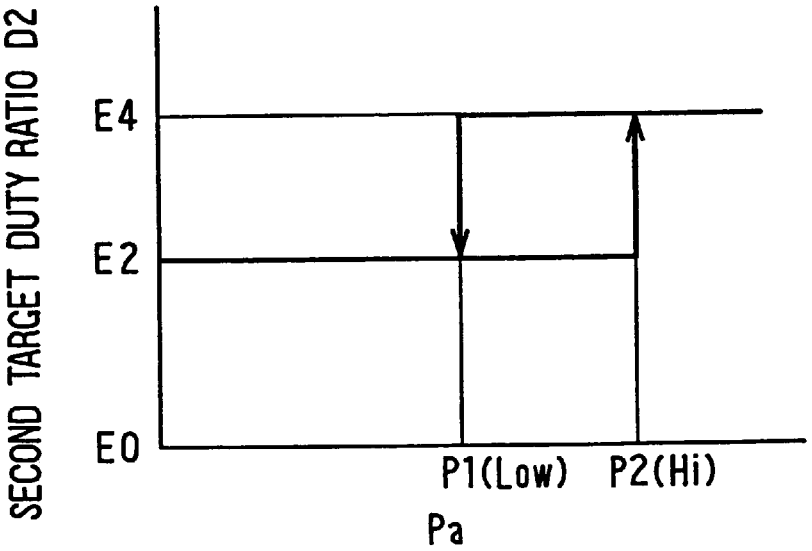
FIG. 4 is a graph showing a relationship between a pressure and a second target duty ratio D2 in the preferred embodiment.

When at step S220 it is determined that the pressure Pa is lower than the first predetermined pressure P2, processing returns to step S200 and the second target duty ratio D2 remains E2. Therefore, based on the pressure Pa, a second target duty ratio D2 is determined. When in the course of the pressure Pa falling the pressure Pa reaches a value lower than the pressure P1, as shown in FIG. 4, the second target duty ratio D2 becomes E2.

Figure 6:
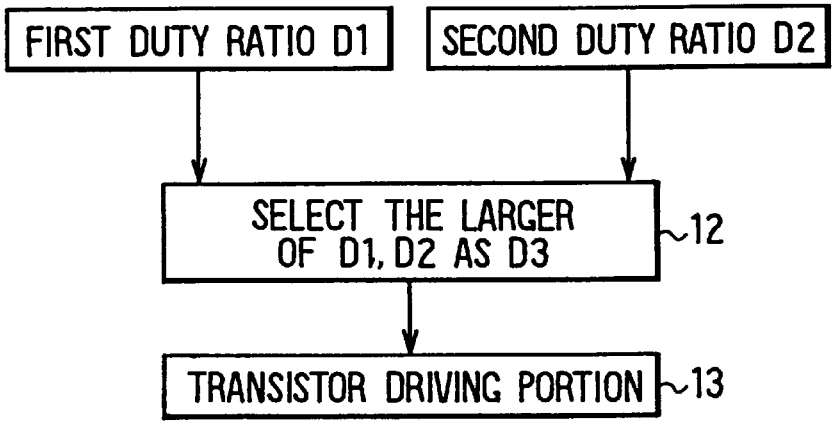
FIG. 6 is a block diagram illustrating a control step in the preferred embodiment.

Because two target duty ratio values D1 and D2 are determined in the above manner, in the control part 12, as shown in FIG. 6, the larger of the first and second duty ratios D1, D2 is selected as a final target duty ratio D3, and is output to the transistor driving part 13. As a result, the cooling capacities required by the radiator 4 and the condenser 3 can both be satisfied.

When the above-mentioned duty ratios D1 and D2 are entered on the same map the ratios have the relationship shown in FIG. 3, and the rated input power A of the electric motors 1*b* in this embodiment has the value shown with a double-dash line in FIG. 3 (As defined earlier, motor rated input power is the input power of a motor in a control circuit in which an air conditioner start-up fan control voltage, or a fan voltage reached when refrigerant pressure exceeds a predetermined value, approximately equals a vehicle battery voltage under a vehicle standard voltage). Also, in this embodiment, the maximum value (E4) of the second target duty ratio D2 is set to be larger than the maximum value (E3) of the first target duty ratio D1 of up to when the water temperature Tw reaches the fourth predetermined temperature T4. However, it should be appreciated that the relationship between E4 and E3 may alternatively be the reverse of that just described.

Also, the input power corresponding to the final target duty ratio D3, which is the larger of the first target duty ratio D1 and the second target duty ratio D2, is set below the rated input power A up to when the water temperature Tw reaches the predetermined temperature T4.

In the present embodiment, when the water temperature Tw exceeds the predetermined temperature T4, an input power above the rated input power A is applied to the electric motors 1*b* without two batteries being connected in series as in a related art apparatus, through the use of one battery B with pulse width modulation only. Additionally, the specifications of the cooling fans 1*a* are set to provide the necessary cooling capacity in the radiator 4 and the condenser 3 up to when the water temperature Tw reaches the fourth predetermined temperature T4, although the input power to the electric motors 1*b* is at or below a value smaller by a predetermined amount than the rated input power A (in this embodiment, 80 W).

That is, to increase the cooling capacity of the cooling fans 1*a*, the matching between the electric motors 1*b* and the cooling fans 1*a* is made different from that in related art. Specifically, supposing that in related art a certain cooling fan has been used with an electric motor having a rated input power of 80 W, when the same electric motor is used in the present preferred embodiment, a fan having a higher cooling capacity than the related art fan is used. Because of this, even when the input power to the electric motors 1*b* is lower than the rated input power A, the necessary cooling capacity can be obtained from the cooling fans 1*a*.

Figure 7:
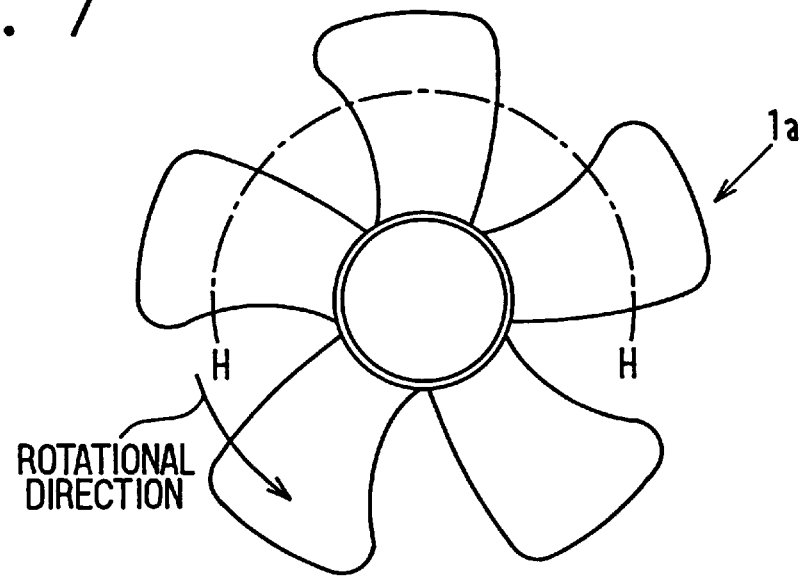
FIG. 7 is a front view of a cooling fan 1*a* in the preferred embodiment.
Figure 8:
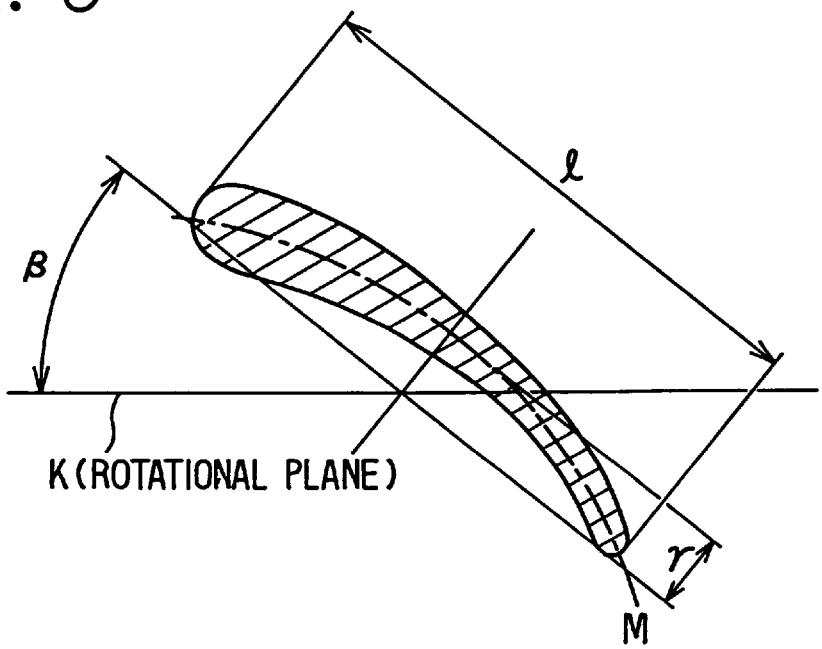
FIG. 8 is a part of a sectional view on the line H—H in FIG. 7.

For example, the cooling draft capacity of the cooling fans 1*a* can be increased in the following ways. FIG. 7 is a front view of a cooling fan 1*a* as seen from the radiator 4 side. FIG. 8 is a sectional view on the line H in FIG. 7. That is, FIG. 8 is a sectional view on an arc about the rotational center of the cooling fan 1*a*.

The cooling capacity of the cooling fan 1*a* can be increased by increasing its external diameter, by increasing the number of fan blades, or by otherwise increasing the chord length l, the setting angle β or the curvature γ (generally called the camber line) of each fan blade. The chord length l is the length of the straight line connecting the front edge and the rear edge of the fan blade, and the setting angle β is the angle made by this straight line and the plane of rotation (a plane parallel with the plane of the paper in FIG. 7 and denoted K in FIG. 8). The curvature γ is the maximum distance between a curve M running through the thickness direction center of the fan blade (the broken line in FIG. 8) and the above-mentioned straight line.

By increasing the cooling capacity of the cooling fans 1*a* in this way, the required cooling capacity can be obtained from the cooling fans 1*a* up to when the water temperature Tw reaches the fourth predetermined temperature T4, even if the input power to the electric motors 1*b* is at a value lower than the rated input power A. As a result, if the larger of the first and second duty ratios D1, D2 is selected, the cooling water and the refrigerant can both be sufficiently cooled.

When on the other hand the water temperature Tw rises above the fourth predetermined temperature T4, the final target duty ratio D3 is made larger than the final target duty ratio D3 when the water temperature Tw is below the fourth predetermined temperature T4. Specifically, the final target duty ratio D3 is set to a first target duty ratio E5 larger than the maximum value E4 of the second target duty ratio, and the input power of the electric motors 1*b* becomes larger than the rated input power A.

As a result, the speed of the cooling fans 1*a* can be raised, the cooling capacity can be increased and the water temperature Tw can thereby be decreased by driving the motors with an input power that is above the rated input power when the water temperature Tw becomes abnormally high.

Figure 9:
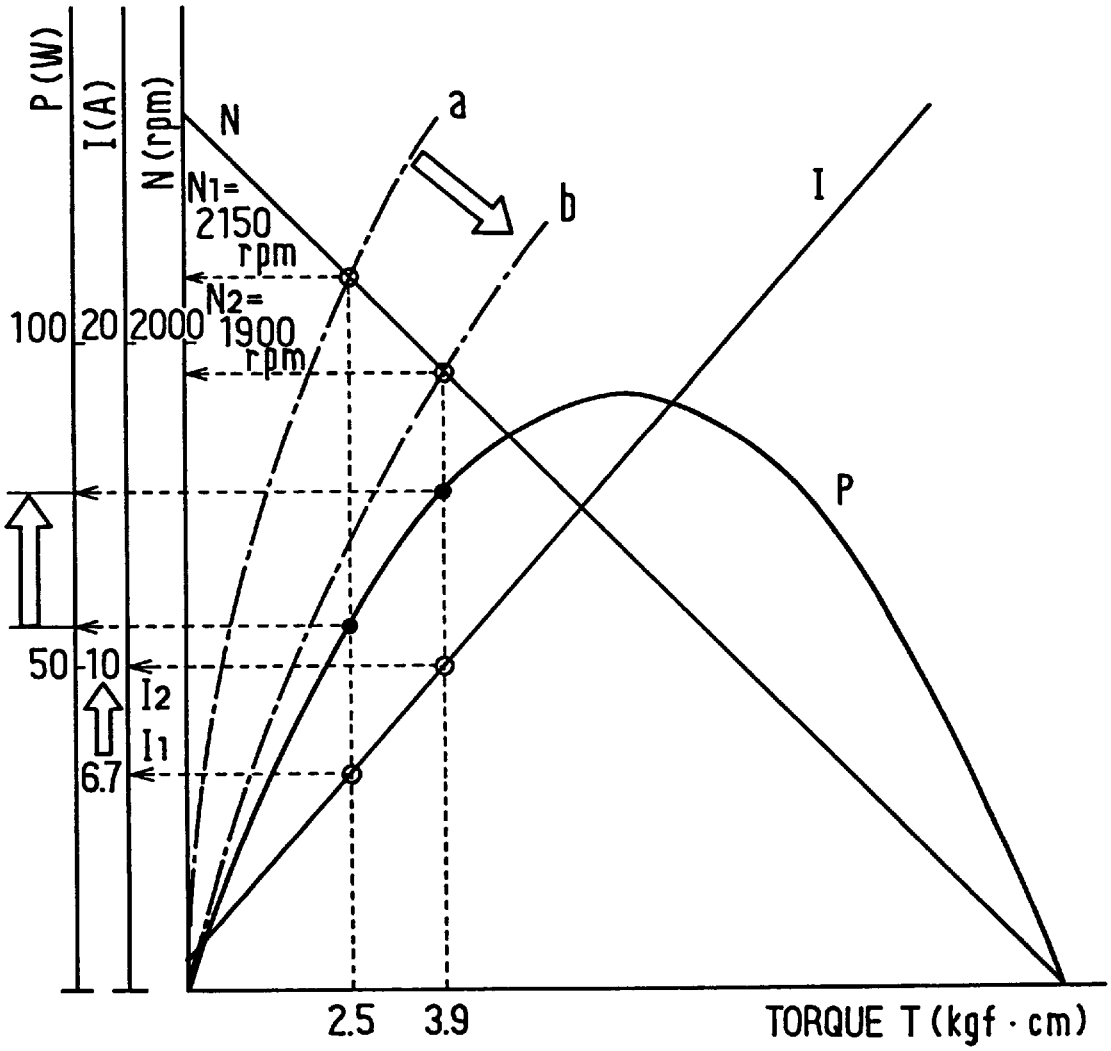
FIG. 9 is a characteristic diagram showing how an electric motor is used in the preferred embodiment.

Referring to FIG. 9, general motor operating characteristics of an electric motor (rated input power 80 W) are shown when used with a related art fan and when used with a cooling fan 1*a*. When the characteristic "a" of a related art fan and the characteristic "b" of a cooling fan of the present preferred embodiment are entered in FIG. 9, the diagram becomes an electric motor operation diagram.

For example, when the speed N of the related art fan is N1 (2150 rpm), the point of intersection between the characteristic line N and the fan characteristic a is an operating point, the current I1 flowing through the electric motor at this time is 6.7 A, and the torque T driving the related art fan is 2.5 kgf·cm. That is, the input power to the electric motor is 12 V×6.7 A=80 W, which is the rated input power of the electric motor.

With the cooling fan 1*a* of the preferred embodiment, on the other hand, although it cannot be compared at the same speed, when the speed N is N2 (1900 rpm), the current I2 flowing through the electric motor is 10 A, and the cooling fan torque T is 3.9 kgf·cm.

That is, because the cooling fan 1*a* has a greater cooling capacity compared to the related art fan, the torque T driving the cooling fan 1*a* increases. In this case, the input power to the electric motor is 12 V×10 A=120 W, meaning that the electric motor is being used at an input power greater than its rated input power.

Thus in this preferred embodiment, because it is possible to apply an input power greater than the rated input power A of the electric motors 1*b* by changing the duty ratio, the electric motors configuration can be compact, as the number of batteries need not be increased as in the related art, and a vehicle cooling apparatus having a simple construction can be provided.

Now, when as in the present preferred embodiment the matching between the electric motors 1*b* and the cooling fans 1*a* is changed, and the electric motors 1*b* are used at an input power greater than the rated input power A, the durability of the electric motors 1*b* deteriorates.

Therefore, in the preferred embodiment, the electric motors 1*b* are controlled, with the maximum value (E4) of the input power corresponding to the second target duty ratio D2 being smaller by a predetermined amount than the above-mentioned rated input power A until the water temperature Tw reaches the fourth predetermined temperature T4, as shown in FIG. 3.

During normal vehicle travel, because the water temperature Tw very rarely becomes higher than the fourth predetermined temperature T4, the final target duty ratio D3 is normally at or below the value E4 that may be required by the air-conditioning side. Therefore, in the preferred embodiment, by setting the duty ratio E4, which is used frequently, to a value smaller by a predetermined amount than the rated input power A, it is possible to increase the durability of the electric motors 1*b*.

Also, in the preferred embodiment, if for some reason the water temperature Tw should remain at or above the fourth predetermined temperature T4 for more than the above-mentioned predetermined time T', even though the water temperature Tw is at or above the fourth predetermined temperature T4, the input power of the electric motors 1*b* is controlled to the maximum value (E4) of the second target duty ratio D2. That is, the input power is controlled to a value lower than the rated input power A. Consequently, the time for which the electric motors 1*b* are used at the rated input power A becomes short. Compared to a case wherein the electric motors 1*b* are used at or above their rated input power A for more than the predetermined time T', the durability of the electric motors 1*b* can be increased.

In the preferred embodiment described above, the cooling capacity required on the condenser 3 side is determined based on the refrigerant pressure, and the second target duty ratio D2 is set in correspondence with the refrigerant pressure. The input power of the electric motors 1*b* determined by this second target duty ratio D2 is always made lower by a predetermined amount than the rated input power A of the electric motors 1*b*. However, the present invention is not limited to such a case. For example, when the passenger compartment needs to be cooled rapidly, such as, for example, when the temperature inside the passenger compartment is above a predetermined temperature (for instance 50° C.), the electric motors 1*b* can be used at an input power higher than the rated input power A. As a result, it is possible to increase the cooling capacity of the air-conditioning. If this cooling is carried out for a short, fixed time only, it will not deteriorate the durability of the electric motors 1*b*.

Also, in the preferred embodiments described above, when the water temperature Tw has been above the fourth predetermined temperature T4 for longer than the predetermined time T', the following measures may be adopted to quicken a fall in the water temperature Tw: [1] cutting off power to the air-conditioning compressor (not shown); [2] switching the air-conditioning system from an outside air intake mode to an inside air intake mode; [3] using a heater core of the air-conditioning system having the above-mentioned cooling water as a heat source to quicken a fall in the water temperature Tw; [4] shifting the above-mentioned set water temperatures T1 through T4 upwardly; and [5] holding a gear so as not to lower the engaged speed of an automatic transmission.

Also, in the preferred embodiments described above, a warning indicating an abnormality may be given to the passenger when the water temperature Tw rises above the fourth predetermined temperature T4. For instance, [1] a warning light may be lit; or [2] intermittent power supply to the electric motors 1*b* may be carried out, for example, by the duty ratio being alternated between 80% and 20%. When this is done, the abnormality is made known by vibration of the electric motors 1*b* and the cooling fans 1*a*.

And in the preferred embodiments described above, the input power of the electric motors 1*b* corresponding to the maximum value of the second target duty ratio D2 may be adjusted to the rated input power A.

And although in the preferred embodiments described above a MOS transistor 11 was used as the switching device for changing the duty ratio, the invention is not limited to such a configuration, as any switching device that is operative to perform the same switching function may be used.

While the above description constitutes the preferred embodiment of the present invention, it should be appreciated that the invention may be modified in other ways without departing from the proper scope or fair meaning of the accompanying claims. Various other advantages of the present invention will become apparent to those skilled in the art after having the benefit of studying the foregoing text and drawings taken in conjunction with the following claims.

What is claimed is:

1. A vehicle cooling system for cooling water flowing through an engine radiator and refrigerant flowing through an air-conditioning condenser, comprising:

a cooling fan for cooling the water flowing through the radiator and the refrigerant flowing through the condenser;

an electric motor that has an associated rated input power and that drives the cooling fan; and a controller operative to generate and output control signals having a calculated duty ratio to drive the motor when a temperature of the water is less than or equal to a predetermined temperature, at an input power lower than the rated input power of the motor;

the controller being operative to determine a first target duty ratio based on the water temperature, and a second target duty ratio based on the refrigerant pressure, and to control the electric motor at a final duty ratio that is a larger of the first and second target duty ratios; and the controller increasing the input power above the rated input power by increasing the final duty ratio if the water temperature reaches the predetermined temperature.

2. The system of claim 1, wherein the controller sets a maximum value of the second target duty ratio greater than a maximum value of the first target duty ratio before the water temperature reaches the predetermined temperature.

3. The system of claim 2, wherein the input power corresponding to the maximum value of the second target duty ratio is smaller by a predetermined amount than the rated input power.

4. The system of claim 2, wherein the controller controls the electric motor at the maximum value of the first target duty ratio when the water temperature subsequently decreases to a temperature less than the predetermined temperature.

5. The system of claim 1, wherein the controller sets the final target duty ratio to a value such that the corresponding input power is lower than the rated input power when the water temperature has been equal to or above the predetermined temperature for a predetermined time.

6. The system of claim 1, wherein the controller sets the input power greater than the rated input power for a fixed time period when temperature inside a passenger compartment is greater than a predetermined temperature.

7. A control apparatus for a motor that selectively drives a vehicle cooling system fan, the apparatus comprising:

a controller that generates motor control signals in response to sensed system operating parameters; and a switching device that receives the motor control signals from the controller and that drives the motor in response thereto;

the controller being operative to generate the motor control signals at a highest target duty ratio among target duty ratios calculated based on the sensed system operating parameters, the highest target duty ratio causing an input power provided to the motor by the switching device to be below a rated input power of the motor when the sensed system operating parameters are below a predetermined level, and to remain above the rated input power only for a predetermined time period when one or more of the sensed system operating parameters is above the predetermined level.

8. The apparatus of claim 7, further comprising an amplifier that receives and amplifies the motor control signals from the controller and that outputs the amplified motor control signals to the switching device.

9. The apparatus of claim 8, further comprising a diode connected across the motor to absorb back electromotive force.

10. The apparatus of claim 7, wherein the apparatus is operative to drive two or more motors.

11. The apparatus of claim 7, wherein the sensed system operating parameters comprise temperature of water flowing through an engine radiator, and pressure of refrigerant flowing through a vehicle air conditioning system;

the controller being operative to calculate a first duty ratio based on the temperature and a second duty ratio based on the pressure, with the highest target duty ratio being selected therefrom.

12. The apparatus of claim 11, wherein a maximum value of the second duty ratio is set below the rated input power and above a maximum value of the first duty ratio.

13. The apparatus of claim 11, wherein a maximum value of the first duty ratio is set below the rated input power and above a maximum value of the first duty ratio.

14. The apparatus of claim 11, wherein the controller may vary the first and second duty ratios within first and second duty ratio ranges, respectively, in response to changes in the temperature and/or the pressure.

15. A method of controlling a motor that drives a vehicle cooling system fan, comprising the steps of:

sensing cooling system operating parameters;

calculating target duty ratios for the sensed cooling system operating parameters;

driving the motor via a motor input power based on a final duty ratio selected as a highest one of the calculated duty ratios;

varying values of the target duty ratios within predetermined duty ratio ranges based on changing operating parameters, the duty ratio ranges each having generated an associated motor input power having a maximum value less than a rated input power of the motor;

increasing the final duty ratio to generate a motor input power that is greater than the rated input power only for a predetermined time period when one or more of the cooling system operating parameters increases to a predetermined high level; and returning the final duty ratio to a level below a level that increases the input power to a level higher than the rated input power after the predetermined time period lapses.

* * * * *